United States Patent [19]

Gorman

[11] Patent Number: 4,911,502

[45] Date of Patent: Mar. 27, 1990

[54] SEATS

[76] Inventor: John D. Gorman, Oaklands, New Mill Lane, Eversley, Hampshire RG27 ORA, England

[21] Appl. No.: 511,491

[22] Filed: Jul. 7, 1983

[30] Foreign Application Priority Data

Jul. 7, 1982 [GB] United Kingdom ..... 8219610
Feb. 25, 1983 [GB] United Kingdom ..... 8305223

[51] Int. Cl.[4] ..... A47C 7/40
[52] U.S. Cl. ..... 297/460; 297/284
[58] Field of Search ..... 297/284, 458–460

[56] References Cited

U.S. PATENT DOCUMENTS

| | | | |
|---|---|---|---|
| 2,063,732 | 12/1936 | Gailey | 297/284 |
| 2,917,104 | 12/1959 | Cottle | 297/284 |
| 2,991,124 | 7/1961 | Schwarz | 297/284 |
| 3,279,849 | 10/1966 | Radke et al. | 297/284 |
| 3,542,421 | 11/1970 | Ambrose | 297/284 X |
| 3,713,696 | 1/1973 | Dudley | 297/452 |
| 3,990,742 | 11/1976 | Glass et al. | 297/284 X |
| 4,161,337 | 7/1979 | Ross et al. | 297/460 X |
| 4,362,334 | 12/1982 | Ross et al. | 297/284 X |

FOREIGN PATENT DOCUMENTS

| | | | |
|---|---|---|---|
| 226408 | 3/1963 | Austria | 297/284 |
| 2856177 | 7/1980 | Fed. Rep. of Germany | 297/284 |
| 483941 | 2/1970 | Switzerland . | |
| 935969 | 9/1963 | United Kingdom | 297/284 |

*Primary Examiner*—James R. Brittain
*Attorney, Agent, or Firm*—Charles W. Helzer

[57] ABSTRACT

A seat comprising a seat portion the upper surface of which is inclined downwardly from front to back at an angle in excess of 10° from the horizontal and a back support comprising support members which support the pelvic girdle on either side of the spine in that region of the pelvic girdle between the iliac crest and the posterior superior iliac spine.

10 Claims, 4 Drawing Sheets

SEATS

Figure 1:
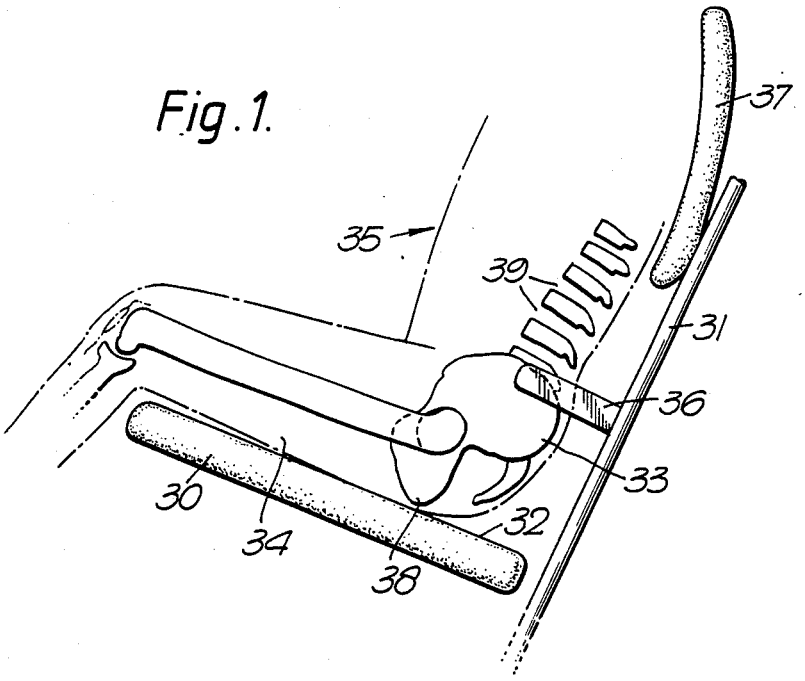

This invention relates to seats.

There have been many attempts to provide seats which will properly support the human body, and particularly the back, with a view to reducing backache and other back problems, to encouraging a correct posture and, where the seat is a vehicle seat, to reducing the fatigue occasioned by long journeys. In general all of these prior proposals have laid emphasis on providing support for the lumbar region or both the thighs and the lumbar region.

It is now believed that this thinking may be wrong and that providing support for the thighs and/or lumbar region may increase rather than decrease back problems due to the fact that when these areas are supported there is a tendency for the pelvic girdle to tilt and adversely affect the curvature of and impose stress on the lower part of the spine.

The present invention has as its object to provide a seat which avoids this wrong thinking and which is capable of providing correct support for the lower part of the back.

The present invention provides a seat having a seat portion and a back support, the back support comprises supplemental support means adapted to support the pelvic girdle of a user on either side of the spine in that region of the pelvic girdle between the iliac crest and the posterior superior iliac spine and the seat portion is adapted to support at least the pelvic girdle of the user from beneath and to restrain the user from sliding forwards on the seat portion away from said support means.

Preferably, the seat portion provides support for the ischial turberosity or seat bone of a user whilst the back support through the supplemental back support means provides support to both sides of the pelvic girdle of the user just below the iliac crest and on the outside of the ilium in the region where the gluteus medius is connected to the ilium.

Said supplemental back support means may comprise a pair of supplemental back support members having supporting surfaces for engaging the back of a user and providing said support for the pelvic girdle, said supporting surfaces extending from a main back support member forwardly and laterally of the seat away from one another.

The said supporting surfaces may be arcuate or may be substantially planar and diverge at an angle to one another. Where said supporting surfaces are substantially planar they may diverge at an included angle of from 80° to 110°, preferably 90° to 100°.

Said supplemental back support members may be spaced apart and may be adjustable so that the spacing therebetween and/or the height thereof may be adjusted.

In addition, the back support may comprise means for supporting the upper part of the back, e.g., a hinged or pivotted support for supporting the thoracic region.

The upper surface of the seat portion may be shaped or angled to restrain a user from sliding forwards on the seat portion. Preferably, at least a portion of the upper surface of the seat portion inclines downwardly from front to back at an angle in excess of 10° from the horizontal, e.g., at an angle of from 12° to 20°, and preferably about 15°, from the horizontal.

Said supplemental back support members, or at least the supporting surfaces thereof, and/or said seat portion may be padded or upholstered.

Said seat portion may be adjustable for angle.

Figure 3:
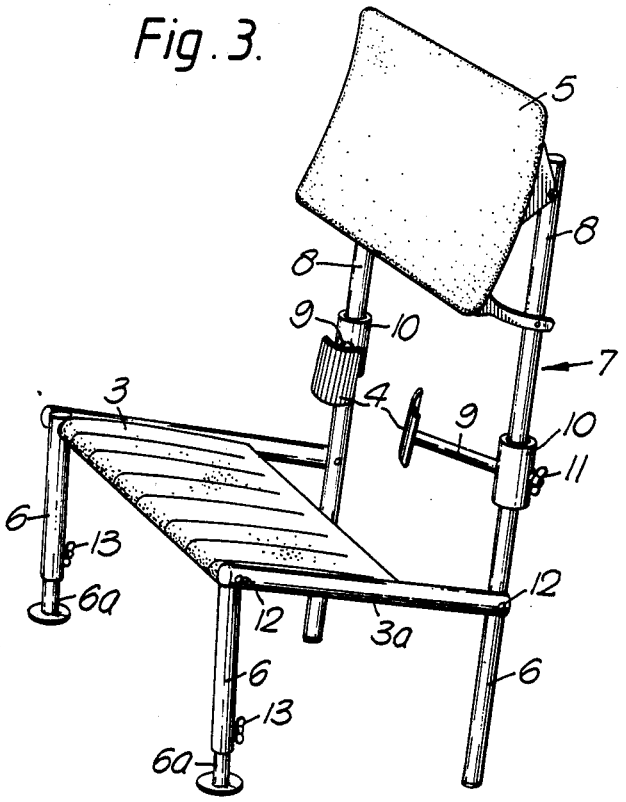
Figure 2:
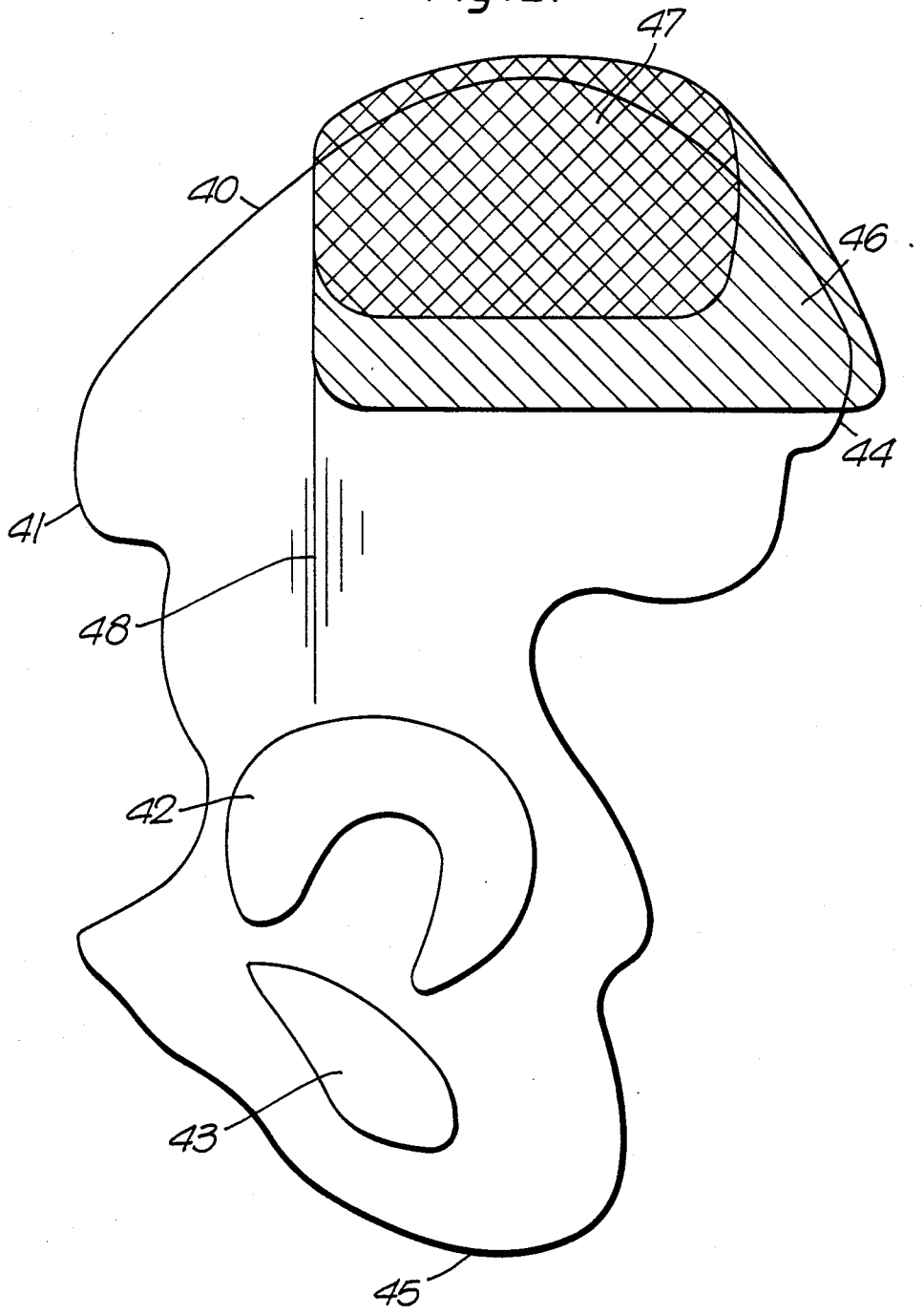
Figure 4:
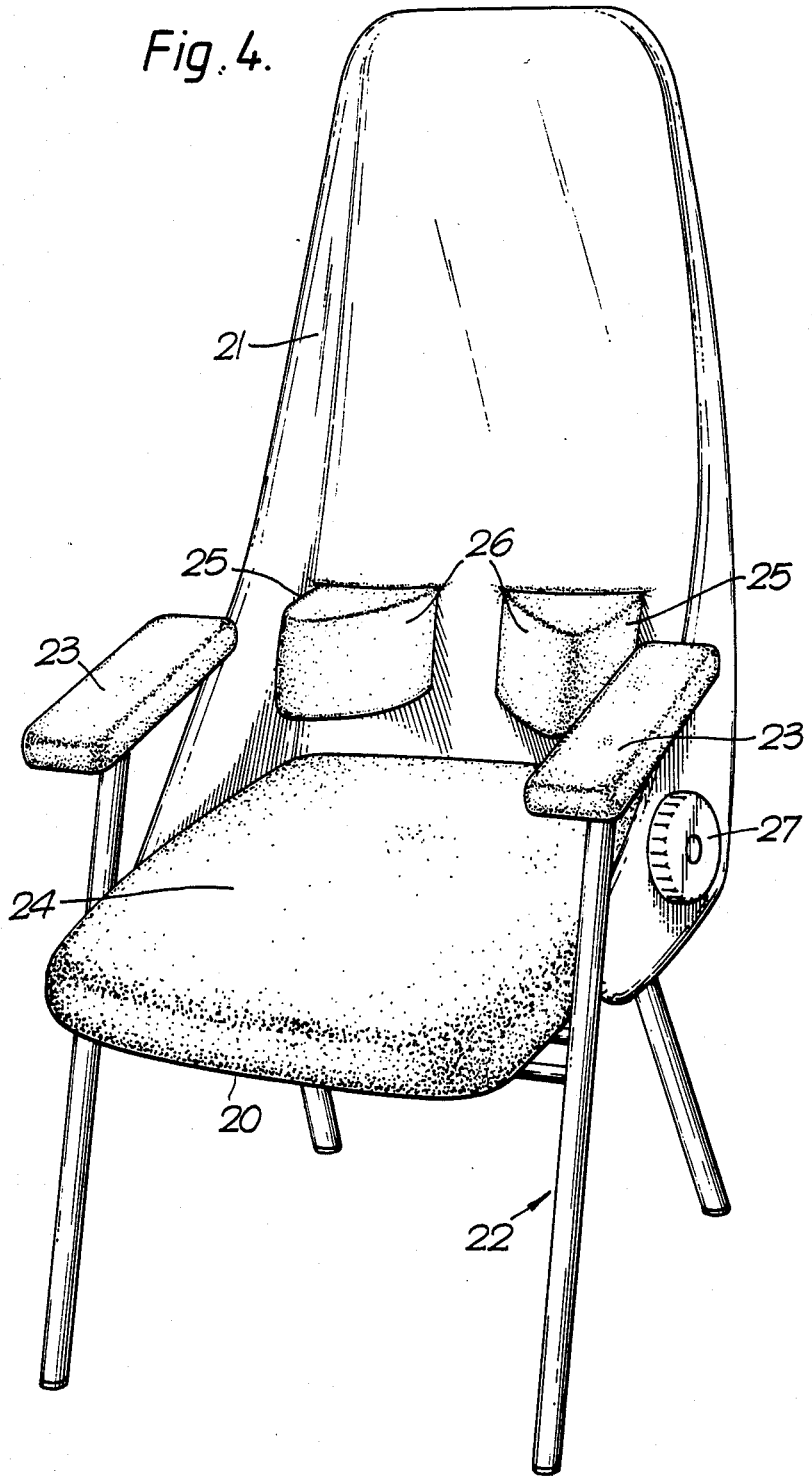
Figure 5:
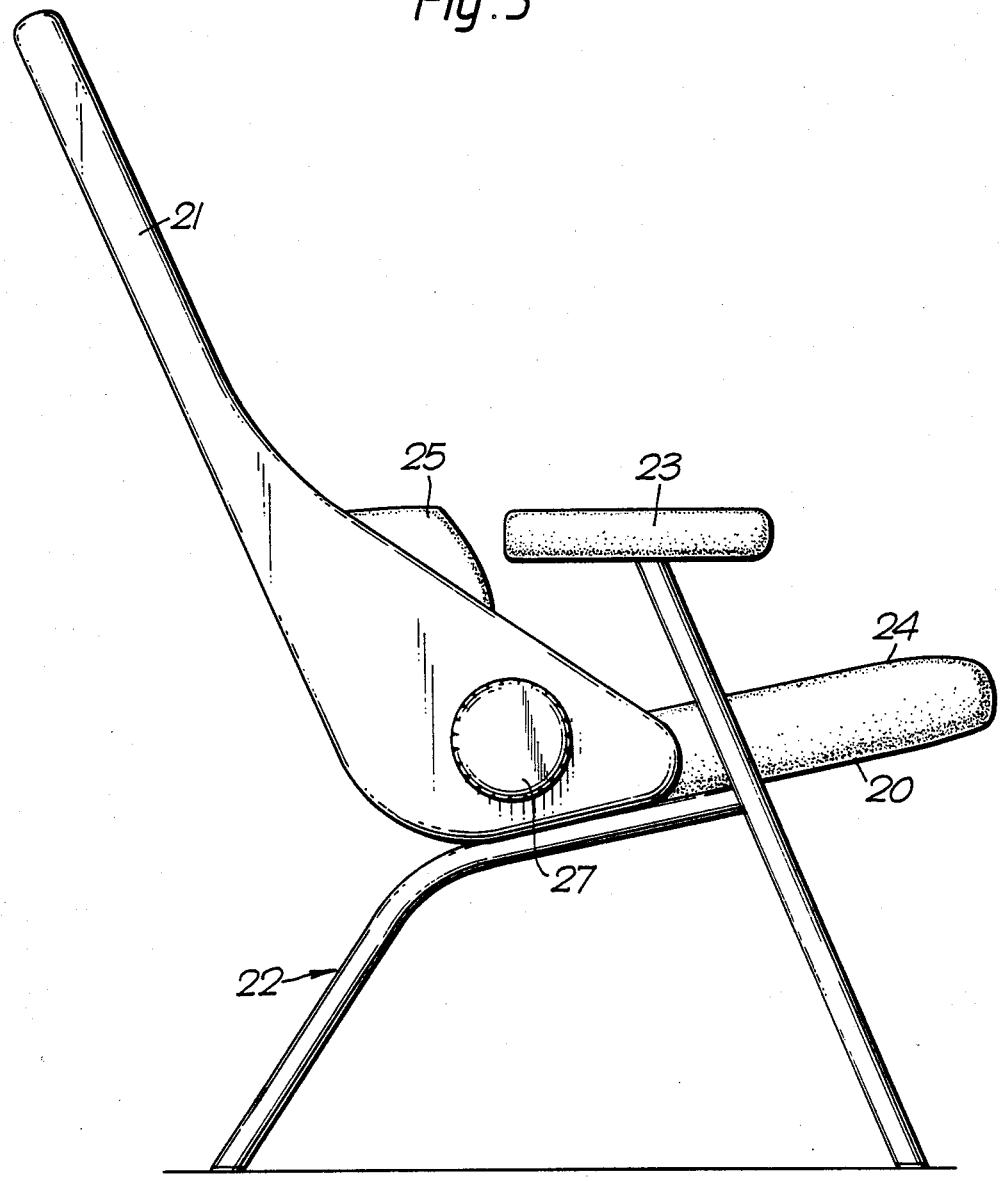

In order that the invention be more readily understood reference will hereinafter be made to the accompanying drawings, in which:

FIG. 1 is a diagram illustrating in side elevation the essential parts of a seat according to the present invention, FIG. 2 is a side view of the left hip bone of a human being in the standing position, FIG. 3 is a diagrammatic illustration of one embodiment of a chair according to the present invention, FIG. 4 is a diagrammatic illustration of another embodiment of a chair according to the present invention, and FIG. 5 is a side elevation of the chair of FIG. 4.

Referring to FIG. 1 of the drawings, it will be seen that the seat illustrated therein comprises a seat portion 30 and a back support 31.

The seat portion 30 is adapted to extend beneath the pelvic girdle 33 and the thighs 34 of a person 35 sitting in the seat and has an upper surface 32 which is substantially linear from front to back and which is inclined at an angle of from 12° to 20°, preferably about 15°, with respect to the horizontal. Although not shown in the drawing it is preferred that the front part of the upper surface 32 is inclined at an angle of about 15° and the rear part of the seat at about 17° with respect to the horizontal. The seat portion 30 may be either cushioned or not and may be substantially linear from side to side or may be curved or otherwise shaped from side to side as desired.

The back support 31 comprises supplemental back support means in the form of a pair of supplemental back support members 36, which may be adjustable as to height and/or spacing therebetween, which are located at substantially the level of the top of the pelvic girdle 33 and which are spaced on either side of the spine so as to extend partially around the back and sides of the pelvic girdle just below the iliac crest, e.g., generally in the region where the gluteus medius is connected to the ilium. The back support 31 also comprises an additional or main back support means 37 for supporting the upper part of the thoracic region of the back. This additional main back support means 37 is preferably pivotally mounted so that it will adjust to the back.

The inclination of at least the upper surface 32 of the seat portion 30 with respect to the horizontal serves to resist the tendency for the ischial tuberosity or seat bone 38 to slide forward on the seat portion 30 whilst the arrangement of the seat portion 30 and the supplemental back support members 36 is such that the six joints 39 of the lumbar region of the spine each flex not more than about 5°, or a total of not more that 30° over the six joints, when a person 35 is properly seated on the seat.

In FIG. 2 the parts of the hip bone illustrated are the iliac crest 40, the anterior superior iliac spine 41, the acetabulum 42, the obturator externus 43, the posterior superior iliac spine 44, the ischial tuberosity or seat bone 45, and the acetabular pillar 48. The support provided by the supplemental back support means of a seat according to the present invention should be on the outside of the ilium in the region between the iliac crest 40, the acetabular pillar 48, and a line extending between the anterior superior iliac spine 41 and the posterior superior iliac spine 44 as is indicated by the cross-hatched area 46, and preferably in the region indicated by the double cross-hatched area 47.

Turning now to FIG. 3 it will be seen that the chair illustrated therein comprises a seat portion 3 supported on four legs 6 and a back support generally indicated at 7. The back support 7 comprises a pair of spaced tubular uprights 8, which are extensions of the rear legs 6, a pair of supplemental back support means 4 carried on arms 9 extending outwardly from sleeves 10 which are slidably adjustable on the tubular uprights 8 so as to be adjustable for both height and spacing therebetween and which can be locked in adjusted position by locking screw means 11 and upper main back support means 5 pivotally mounted on the upper ends of the tubular uprights 8. The side members 3a of the seat portion 3 are pivotally connected to the uprights 8 and to the front legs 6 as shown at 12 and the front legs 6 comprise telescopic extensions 6a lockable in adjusted position by locking screw means 13, thus enabling the height of the front legs 6, and hence the angle of inclination of the seat portion 3, to be adjusted.

The chair shown in FIGS. 4 and 5 is a upholstered chair and comprises an upholstered seat portion 20 and an upholstered main back support 21 which are supported on a tubular metal frame 22 provided with upholstered arm rests 23. The upper surface 24 of the seat portion 20 inclines downwardly from front to back at an angle of from 12° to 20°, preferably about 15°, with respect to the horizontal as previously described. The back support 21 comprises a pair of spaced supplemental back support members 25 the back supporting surfaces 26 of which diverge outwardly with respect to one another at an included angle of from 80° to 110°, preferably 90° to 100° and more preferably about 90°. The main back support member 21 is angularly adjustable relative to the seat portion 20 by means of a knob 27 and a suitable known tilt mechanism (not shown).

With the seats of the present invention, the supplemental back support means exerts a force on the pelvis of a user which tends to urge the lower part of the user's body forwards and the user will initially tend to counteract this by using the back muscle to help maintain the required body shape. However, after a while the user will wish to relax the back muscle and flex the spine and this will usually have the effect of the user sliding forward on the seat portion and so undesirably tilting the pelvic girdle. This effect is offset or mitigated either by suitably inclining and/or shaping the upper surface of the seat portion as previously described.

Seats according to the present invention are particularly suitable for use in the home, in vehicles, e.g., in automobiles, buses, coaches, trains, aircraft, or the like, where they can appreciably aid in reducing the fatigue of long journeys, as well as for commercial and industrial seating, such as typists chairs, where persons may be seated in one position for considerable parts of their working day.

I claim:

1. A seat having a seat portion and a back support, said seat portion serving to support at least the pelvic girdle of a user from beneath with at least a part of the upper surface of the seat portion being inclined downwardly from front to back at an angle in excess of 10° but not exceeding 20° from the horizontal to restrain the user from sliding forwards on the seat portion away from said back support, and wherein the back support comprises a main back support member and a pair of fixed laterally spaced apart supplemental back support members having supplemental pelvic region supporting surfaces for engaging substantially the whole of each side of the lower pelvic region of the back of a user, said fixed supplemental back support members extending from the main back support member forwardly and laterally away from one another and supporting the pelvic girdle of a user on either side of the spine in that region of the pelvic girdle between the iliac crest, the actabular pillar and a line extending between the anterior superior iliac spine and the posterior superior iliac spine to prevent undesirable backwards tilting of the pelvic girdle of the user while sitting in the seat.

2. A seat according to claim 1, wherein said supplemental back support members are adapted to support both sides of the pelvic girdle of a user just below the iliac crest and on the outside of the ilium in the region where the gluteus medius is connected to the ilium.

3. A seat according to claim 1, wherein said supplemental back supporting surfaces are arcuate.

4. A seat according to claim 1 wherein said supplemental back supporting surfaces are substantially planar and diverge at an angle to one another.

5. A seat accoarding to claim 4, wherein said supporting surfaces diverge at an included angle of from 80° to 110°.

6. A seat according to claim 5, wherein said supporting surfaces diverge at an included angle of from 90° to 100°.

7. A seat according to claim 1, wherein the spacing between said supplemental back support members is adjustable.

8. A seat according to claim 1, wherein said supplemental back support members are adjustable for height.

9. A seat according to claim 1, wherein said supplemental back support members are padded.

10. A seat according to claim 1, wherein at least a portion of the upper surface of the seat portion inclines downwardly from front to back at an angle of from 12° to 20° from the horizontal.

* * * * *